US005495211A

United States Patent [19]

Liechty

[11] Patent Number: 5,495,211

[45] Date of Patent: Feb. 27, 1996

[54] RECONFIGURATION MICROSTRIP TRANSMISSION LINE NETWORK

[75] Inventor: Robert B. Liechty, Greenville, Tex.

[73] Assignee: E–Systems, Inc., Dallas, Tex.

[21] Appl. No.: 367,725

[22] Filed: Jan. 3, 1995

[51] Int. Cl.[6] ..... H01P 1/10; H01P 1/22

[52] U.S. Cl. ..... 333/101; 327/369; 333/104; 333/81 A; 333/246; 333/262

[58] Field of Search ..... 333/101, 104, 333/161, 81 A, 246, 262; 327/369, 514, 515

[56] References Cited

U.S. PATENT DOCUMENTS

| | | | |
|---|---|---|---|
| 2,997,675 | 8/1961 | Anderson | 333/101 |
| 3,295,138 | 12/1966 | Nelson . | |
| 3,568,105 | 3/1971 | Felsenheld . | |
| 4,568,893 | 2/1986 | Sharma | 333/157 |
| 4,604,591 | 8/1986 | Vasile | 333/18 |
| 4,652,883 | 3/1987 | Andricos | 342/372 |
| 4,675,624 | 6/1987 | Rosen et al. | 333/161 |
| 4,686,535 | 8/1987 | Lalezari | 343/700 MS |
| 4,764,740 | 8/1988 | Meyer | 333/164 |
| 4,825,081 | 4/1989 | Wille et al. | 250/551 |
| 4,835,500 | 5/1989 | Sequeira | 333/258 |
| 4,874,981 | 10/1989 | Spindt | 313/309 |
| 4,967,162 | 10/1990 | Barnett et al. | 330/43 |
| 5,051,754 | 9/1991 | Newberg | 342/375 |
| 5,051,789 | 9/1991 | Rosen et al. . | |
| 5,055,810 | 10/1991 | de La Chapelle et al. | 333/262 |
| 5,083,100 | 1/1992 | Hawkins et al. | 333/164 |
| 5,099,214 | 3/1992 | Rosen et al. | 333/157 |
| 5,109,449 | 4/1992 | Newberg et al. | 385/46 |
| 5,116,807 | 5/1992 | Romanofsky et al. | 505/1 |
| 5,117,239 | 5/1992 | Riza | 342/375 |
| 5,162,803 | 11/1992 | Chen | 342/372 |
| 5,258,626 | 11/1993 | Suzuki et al. | 257/39 |
| 5,289,193 | 2/1994 | Lenormand et al. | 342/374 |
| 5,385,883 | 1/1995 | Lenzing et al. | 333/161 X |

FOREIGN PATENT DOCUMENTS

| | | | |
|---|---|---|---|
| 54403 | 3/1982 | Japan | 333/81 A |

OTHER PUBLICATIONS

Leonberger et al., *High–speed InP optoelectronic switch*, Applied Physics Letters, 1 Nov. 1979, pp. 712–714.

Neikirk et al., *Optically–Controlled Coplanar Waveguide Phase Shifters*, Microwave Journal, Dec. 1989, pp. 77–88.

*Primary Examiner*—Paul Gensler

*Attorney, Agent, or Firm*—Harold E. Meier

[57] ABSTRACT

The present invention discloses a reconfigurable microstrip transmission line network having a microstrip circuit consisting of an RF ground plan separated from a transmission layer by a dielectric layer. The transmission layer comprises a silicon material responsive to a plurality of excitation sources. The excitation sources generate excitation beams which upon interacting with the surface of the transmission layer actuate a conductive pathway. By alternately actuating and deactuating the excitation sources and varying the excitation beams, the configuration of the microstrip transmission line network upon the transmission layer may be reconfigured as desired.

21 Claims, 2 Drawing Sheets

RECONFIGURATION MICROSTRIP TRANSMISSION LINE NETWORK

TECHNICAL FIELD

This invention relates to microstrip transmission line networks, and more particularly to reconfigurable microstrip transmission line networks.

BACKGROUND OF THE INVENTION

Prior art microstrip transmission line networks are devices defining fixed transmission line paths within the microstrip circuitry. Microstrip networks are used in a variety of RF devices including antenna feed networks, switches, tunable filters, matching networks, various distributed resistive elements and beam steering applications. Microstrip circuit networks used for RF beam steering applications are limited in various ways. The length and width of the microstrip transmission lines are static and thus, cannot be varied to increase or decrease the amount of signal delay needed for beam steering an electrically scanned antenna array. Further, the conductivity of the transmission lines remain the same during operation, preventing a transmission line from varying between conductive and lossy elements. Microstrip transmission line networks are also extensively used with RF switching applications. Present applications within RF switches require the use of pin-diodes and biasing networks. Distortion effects and port isolation are other concerns arising within RF switching applications.

Thus, a need has arisen for a microstrip transmission line network capable of overcoming the above-mentioned problems in the various applications using microstrip transmission line networks that provides a versatile, variable and reconfigurable transmission line characteristics and configurations.

SUMMARY OF THE INVENTION

The present invention overcomes the foregoing and other problems with a reconfigurable microstrip transmission line network. The reconfigurable network consists of a plurality of excitation sources each generating an excitation beam. These excitation sources may generate electron or photonic energies as desired. The excitation beams illuminate areas upon a transmission layer of a microstrip circuit. The microstrip circuit further includes a dielectric layer insulating the transmission layer from an RF ground plane layer. The excitation beams interact with areas on the transmission layer to define conductive pathways within the surface of the transmission layer. These conductive pathways are selectively actuable in response to the activation of the excitation beams.

DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
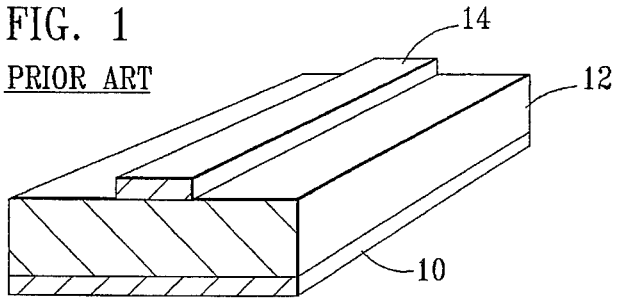
FIG. 1 PRIOR ART
FIG. 1 is a prior art illustration of a microstrip transmission line in section used within a microstrip transmission line network.

Referring now to the Drawings, and more particularly to FIG. 1, there is illustrated in section a prior art microstrip transmission line. The prior art microstrip transmission lines include a ground plane layer 10 having an insulator 12 deposited on its surface. Along the top of the insulator 12 is a strip conductor 14. The strip conductor 14 defines a fixed conductive pathway within a microstrip transmission line network.

Figure 2:
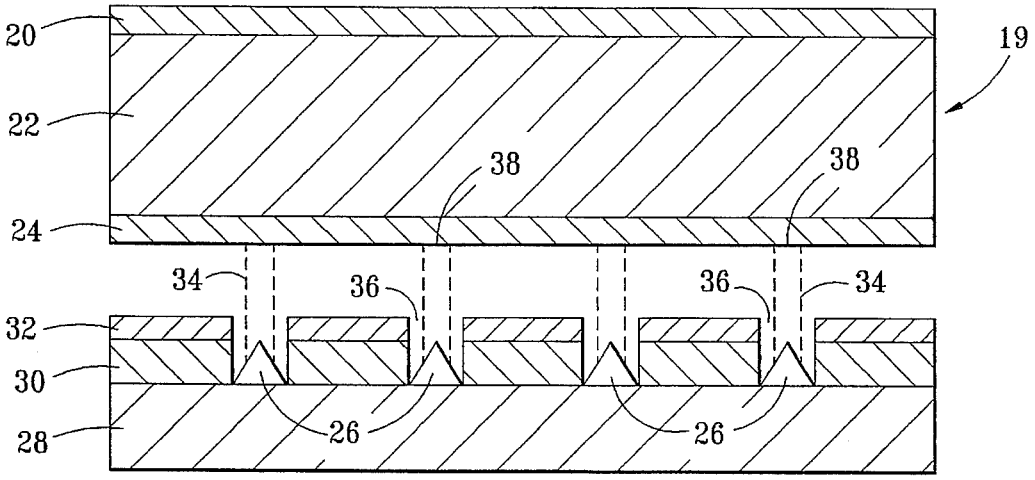
FIG. 2 illustrates an end view, in section, of a reconfigurable microstrip transmission line network of the present invention.

Referring now to FIG. 2, there is illustrated an end view section of a reconfigurable microstrip transmission line network of the present invention. The reconfigurable microstrip transmission line network includes a network substrate 19 having an RF ground plane 20 bonded to a first side of a dielectric layer 22. The dielectric layer 22 separates the RF ground plane 20 from a transmission layer 24. In the preferred embodiment, the transmission layer is formed of a thin layer of silicon, but similar materials may be used in alternative embodiments. The transmission layer 24 acts as the media for defining a plurality of conductive pathways 38 within the reconfigurable microstrip transmission line network.

The plurality of conductive pathways 38 within the transmission layer 24 are defined by a plurality of miniature vacuum field effect devices (spindt cathodes) 26. The spindt cathodes 26 are mounted upon a silicon base 28 and are surrounded by a dielectric layer 30, preferably of silicon dioxide, covered by a metallic gate film 32. The spindt cathodes 26 emit an electron beam 34 through a plurality of openings 36 within the dielectric and metallic gate film layers 30 and 32.

Figure 3:
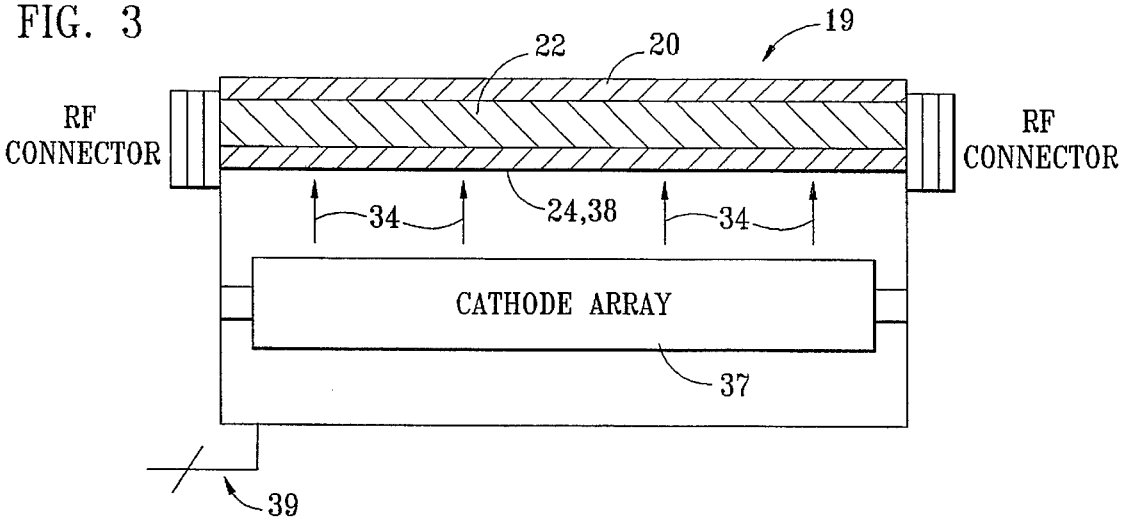
FIG. 3 illustrates a side view of a reconfigurable microstrip network using electron beam excitation.

Referring now also to FIG. 3, there is more fully illustrated the configuration of the spindt cathodes 26 with the network substrate 19. The spindt cathodes 26 are configured into a cathode array 37 closely situated with the network substrate 19. The cathode array 37 comprises a two dimensional array of spindt cathodes. The array 37 may define an x-y coordinate system of cathodes covering the entire surface area of the transmission layer 24 or alternatively may only be placed to define the desired conductive pathways 38 within the transmission layer 24. The individual cathodes 26 within the array 37 are selectively actuated and deactuated via power/address lines 39.

The electron beams 34 from the cathode array 37 excite a conductive pathway 38 on the transmission layer 24 and creates a conductive region that acts as a transmission line. The electron beam 34 interacts with the silicon of the transmission layer 24 and generates a sufficient number of electron hole pairs within a region to make the region conductive. While excited, the conductive pathways 38 act as microstrip transmission lines. When the spindt cathode 26 is deactuated, the conductive pathway 38 of the silicon layer 24 is no longer excited, and the electrons return to their normal state, causing the conductive pathways to cease to be conductive.

The spindt cathodes 26 within the cathode array 37 are alternately actuated to activate and deactivate the conductive pathways 38 within the transmission layer 24. Conductive pathway 38 length and width is varied by addressing the on-off states of the required spindt cathodes 26 within the data array 37 through the power/address lines 39. The conductivity of a conductive pathway 38 may be changed by controlling the intensity of the electron beam 34 emitted by the spindt cathodes 26. By varying the degrees of conductivity within the conductive pathways 38, both conductive and lossy elements may be produced.

Figure 4:
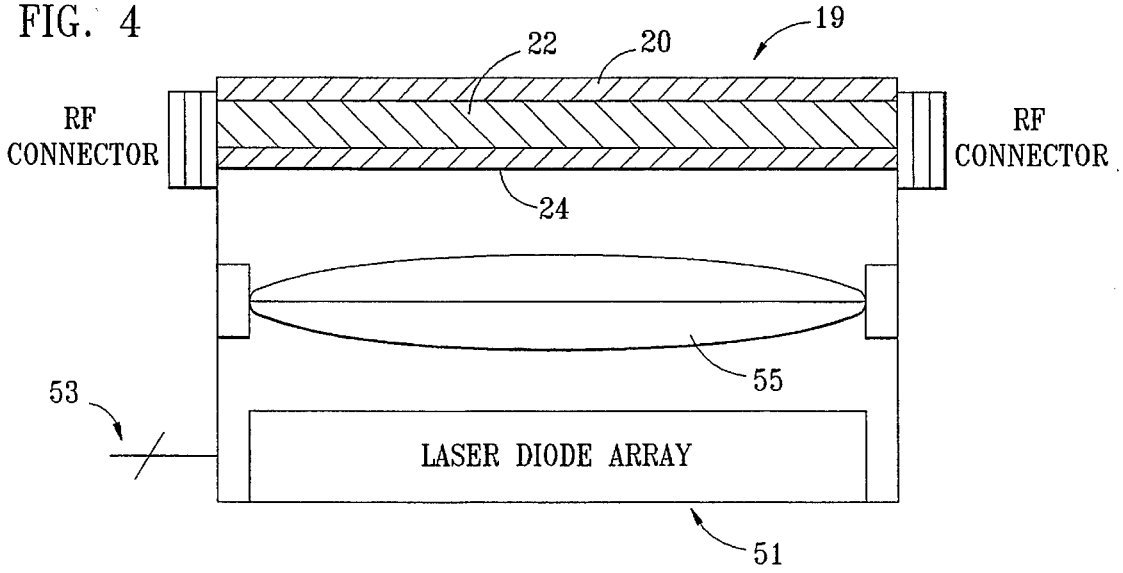
FIG. 4 illustrates a side view of a reconfigurable microstrip network using optical excitation.

It is further noted that while the preferred embodiment of the present invention illustrates the use of spindt cathodes 26 for exciting the transmission layer 24 to generate the conductive pathways 38, optical sources generating a photon beam may also be used to generate the conductive pathways 38 in a similar manner. FIG. 4 illustrates a reconfigurable microstrip transmission line network using a plurality of laser diodes arranged in a laser diode array 51. As described previously with respect to the spindt cathodes of FIG. 3, the laser diodes are arranged within an array to define an x-y coordinate system or an arrangement outlining the desired conductive pathways 38 within the transmission layer 24. The individual laser diodes within the laser diode array 51 are actuated and deactuated using power/address lines 53. The photon emission from the laser diode array are focused by focusing lenses 55.

Figure 5:
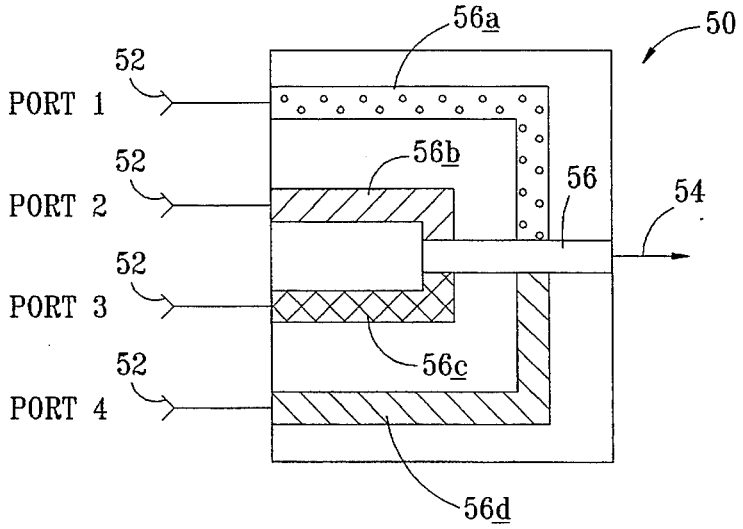
FIG. 5 illustrates the application of a reconfigurable microstrip transmission line network within an RF switch.

Referring now to FIG. 5, there is illustrated the transmission layer 24 of an RF switch 50 utilizing a reconfigurable microstrip transmission line network. The RF switch 50 includes a plurality of input ports 52 and a single output port 54. The output port 54 may be connected to any of the input ports 52 by illuminating one of the four conductive pathways 56 illustrated with a number of spindt cathodes (not shown). For example, by illuminating path **56*a*, the input of port one is output through output port 54**. It is noted that the above-described application comprises only one potential use of a reconfigurable microstrip transmission line network and that a variety of uses for a reconfigurable microstrip transmission line network would be readily apparent to those skilled in the art.

Although preferred and alternative embodiments of the present invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

What is claimed is:

1. A reconfigurable microstrip transmission line network comprising:

a microstrip circuit having a transmission layer; and an electron beam excitation source for generating one or more excitation beams, the one or more excitation beams defining in the transmission layer a plurality of selectively actuable conductive pathways responsive to an excitation beam.

2. The transmission line network of claim 1, wherein the excitation source comprises a spindt cathode.

3. The transmission line network of claim 1, wherein the excitation source generates one or more variable excitation beams to vary conductivity of the generated conductive pathways.

4. The transmission line network of claim 1, further including means for actuating the one or more excitation beams to vary length (l) and width (w) of the conductive pathways.

5. The transmission line network of claim 1, wherein the transmission layer comprises a silicon material.

6. The transmission line network of claim 1 further including:

a dielectric layer having a first side bonded to the transmission layer; and a ground plane bonded to a second side of the dielectric layer.

7. A reconfigurable microstrip network comprising:

a dielectric layer;

a ground plane layer bonded to a first side of the dielectric layer;

a transmission layer bonded to a second side of the dielectric layer; and an excitation source comprising a plurality of electron beam sources for generating one or more excitation beams, the one or more excitation beams defining in the transmission layer at least one selectively actuable conductive pathway responsive to the one or more excitation beams.

8. The reconfigurable microstrip network of claim 7, wherein the transmission layer comprises a silicon material.

9. The reconfigurable microstrip network of claim 7, wherein the excitation source comprises a plurality of spindt cathodes.

10. The reconfigurable microstrip network of claim 7, wherein the one or more excitation beams are variable to enable the variance of conductivity of the actuated conductive pathways.

11. The reconfigurable microstrip network of claim 7, further including means for actuating the one or more excitation beams to vary length (l) and width (w) of the conductive pathways.

12. A method for reconfiguring a microstrip network having a transmission layer, comprising the steps of:

generating an electron excitation beam;

actuating a conductive pathway in a transmission layer of said microstrip network by directing the excitation beam onto the transmission layer; and deactuating the conductive pathway by removing the excitation beam from the transmission layer.

13. A reconfigurable microstrip transmission line network comprising:

a microstrip circuit having a transmission layer; and an electron beam excitation source for generating one or more excitation beams directed to the transmission layer, the one or more excitation beams defining in the transmission layer a selectively actuable conductive pathway having selected geometric dimensions varying with the selective actuation of the one or more beams to produce said conductive pathway.

14. The transmission line network of claim 13, wherein the transmission layer comprises a silicon material.

15. The transmission line network of claim 13, wherein the one or more beams are selectively actuated to vary the length of the conductive pathway.

16. The transmission line network of claim 13, wherein the one or more beams are selectively actuated to vary the width of the conductive pathway.

17. The transmission line network of claim 13, wherein the excitation source generates one or more variable excitation beams to vary conductivity of the generated conductive pathway.

18. A reconfigurable microstrip network comprising:

a dielectric layer;

a ground plane layer bonded to a first side of the dielectric layer;

a transmission layer bonded to a second side of the dielectric layer; and an electron beam excitation source for generating one or more excitation beams, said one or more excitation beams generating a conductive pathway having selected geometric dimensions within the transmission layer.

19. The microstrip network of claim 18, wherein the transmission layer comprises a silicon material.

20. A reconfigurable transmission line switch network comprising:

a dielectric layer;

a ground plane layer bonded to a first side of the dielectric layer;

a transmission layer bonded to a second side of the dielectric layer; and a plurality of input ports connected to the transmission layer;

an output port connected to the transmission layer; and an electron beam excitation source for generating one or more excitation beams, said one or more excitation beams generating a conductive pathway in the transmission layer between a selected one of the input ports and the output port.

21. The switch network of claim 20, wherein the transmission layer comprises a silicon material.

* * * * *